US005456227A

United States Patent [19]

Shimmell et al.

[11] Patent Number: 5,456,227

[45] Date of Patent: Oct. 10, 1995

[54] STRUCTURAL BAFFLE FOR INTERNAL COMBUSTION ENGINE

[75] Inventors: Dennis S. Shimmell, Hudsonville; James R. Fitzell, Coopersville, both of Mich.

[73] Assignee: Nelson Metal Products Corporation, Grandville, Mich.

[21] Appl. No.: 285,394

[22] Filed: Aug. 3, 1994

[51] Int. Cl.[6] ..... F02F 7/00

[52] U.S. Cl. ..... 123/195 H

[58] Field of Search ..... 123/195 R, 195 H

[56] References Cited

U.S. PATENT DOCUMENTS 4,911,118 3/1990 Kageyama et al. ..... 123/195 H 5,024,189 6/1991 Ushio et al. ..... 123/195 H 5,222,467 6/1993 Sasada ..... 123/195 H

*Primary Examiner*—Noah P. Kamen

*Attorney, Agent, or Firm*—Warner Norcross & Judd

[57] ABSTRACT

A structural baffle for reducing both crankshaft torsional vibration and oil aeration in an internal combustion engine. The baffle includes a baffle plate and a number of upright members. The baffle plate isolates the oil reservoir from the turbulence generated by the crankshaft, and includes openings allowing oil flowing from the engine to return to the oil reservoir. Preferably, the baffle plate includes a number of oil return towers which align with the oil return ports of the engine to channel oil to the reservoir. The upright members are mounted to the bearing caps both to bolster the bearing caps and to support the baffle plate beyond the throw of the crankshaft.

4 Claims, 3 Drawing Sheets

STRUCTURAL BAFFLE FOR INTERNAL COMBUSTION ENGINE

BACKGROUND OF THE INVENTION

The present invention relates to internal combustion engines, and more particularly to a structural baffle for such engines.

A typical internal combustion engine includes an engine block, pistons, connecting rods, a crankshaft, bearing caps, and an oil pan. Each piston reciprocates within a cylinder in the engine block. The crankshaft includes a crankpin for each piston offset from the primary axis of the crankshaft. Each piston is connected to one of the crankpins by one of the connecting rods. The crankshaft is rotatably secured to the engine block by a number of bearing caps bolted to the engine block. The oil pan is bolted to the engine block to enclose the engine components and provide a reservoir for engine oil.

In operation, a mixture of air and fuel is sequentially introduced into the combustion chambers over each piston and then ignited. The pressure from the resulting explosion drives the piston downward in the cylinder in turn forcing the connecting rod downward. Because of the axial offset of the crankpins during the ignition phase of their respective cylinders, the downward motion of the connecting rod is translated into rotational movement of the crankshaft. Unfortunately, the initial force of the explosion causes the crankshaft to flex or bend along its axis as the piston and connecting rod attempt to force the crankpin to rotate ahead of the rest of the crankshaft. This flexing motion causes the bearing caps to bend laterally and results in undesired torsional vibrations.

Such torsional vibrations are dampened in primarily four ways. First, the conventional crankshaft can be replaced with a heavier crankshaft offering greater resistance to the flexing motion. Second, the conventional bearing caps can be replaced with heavier bearing caps to provide greater resistance to the flexing motion of the crankshaft. Third, a lower crank case housing, or girdle, can be installed to strengthen the bearing caps against flexing. And fourth, a ladder can be installed to bolster the bearing caps and reduce the magnitude of the torsional vibrations. Such ladders are reinforcing pieces that extend between and structurally interconnect the otherwise independent bearing caps.

Another problem inherent in internal combustion engines stems from the turbulence created by the rotational movement of the crankshaft. Because of the close proximity of the oil reservoir to the crankshaft, the air turbulence created by the spinning crankshaft may result in undesired aeration of the engine oil. Further, undesired aeration of the oil may result from sudden movement of the oil into the throw of the crankshaft caused by hard cornering or sudden acceleration or deceleration. In such instances, the oil is cast into suspension as it collides with the moving crankpins and connecting rods, ultimately resulting in aeration.

There is also a concern that oil returning to the oil pan in the normal oil flow path may flow down and hit the spinning crankshaft, resulting in a loss of energy from the system. While this loss of energy is relatively small, it is a significant concern in high performance engines.

To overcome the problems associated with aeration and oil return, many automobile engines are provided with a windage tray or oil pan baffle. The baffle is typically stamped from sheet metal and mounts within the oil pan to provide a turbulence barrier between the crankshaft and the oil reservoir. The baffle shelters the oil from turbulence and prevents movement of the oil into the throw of the crankshaft.

SUMMARY OF THE INVENTION

The aforementioned problems are solved by the present invention providing a structural baffle that both bolsters the bearing caps and controlled movement of the engine oil. The structural baffle is mounted on the bearing caps. The baffle has sufficient structure and strength to bolster the bearing caps. The baffle also has sufficient surface area to function as an oil pan baffle.

As disclosed, the invention includes a series of uprights extending from a baffle plate. The uprights mount to the bearing caps and are of sufficient height to hold the baffle plate out of the throw of the crankshaft. The baffle plate provides structural support for the uprights and is contoured to separate the oil reservoir from the turbulence created by the rotating crankshaft. Most preferably, the baffle plate includes a series of oil return openings and towers which direct oil returning from the engine to the reservoir.

The present invention replaces both the ladder and the oil pan baffle by providing a simple and effective apparatus for reducing both torsional vibrations and oil aeration. It also eliminates the need for a separate baffle mounted in the oil pan.

With respect to the most preferred embodiment, because the structural baffle is installed prior to the oil sump pickup assembly, it does not require the large mounting hole necessary in conventional oil pan baffles. Further, the oil flow towers reduce the loss of energy in high performance engines by preventing returning oil from passing into the throw of the crankshaft.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
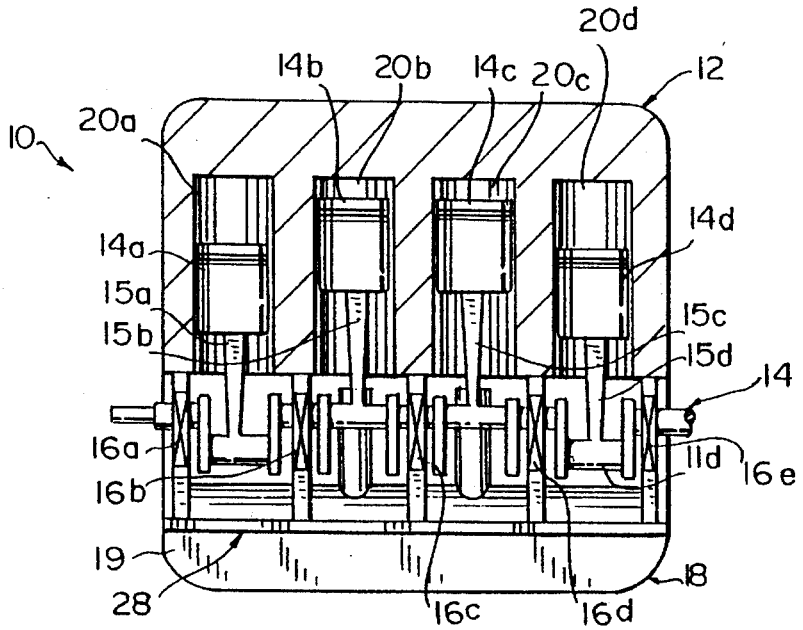
FIG. 1 is a sectional view of an engine incorporating the structural baffle.
Figure 2:
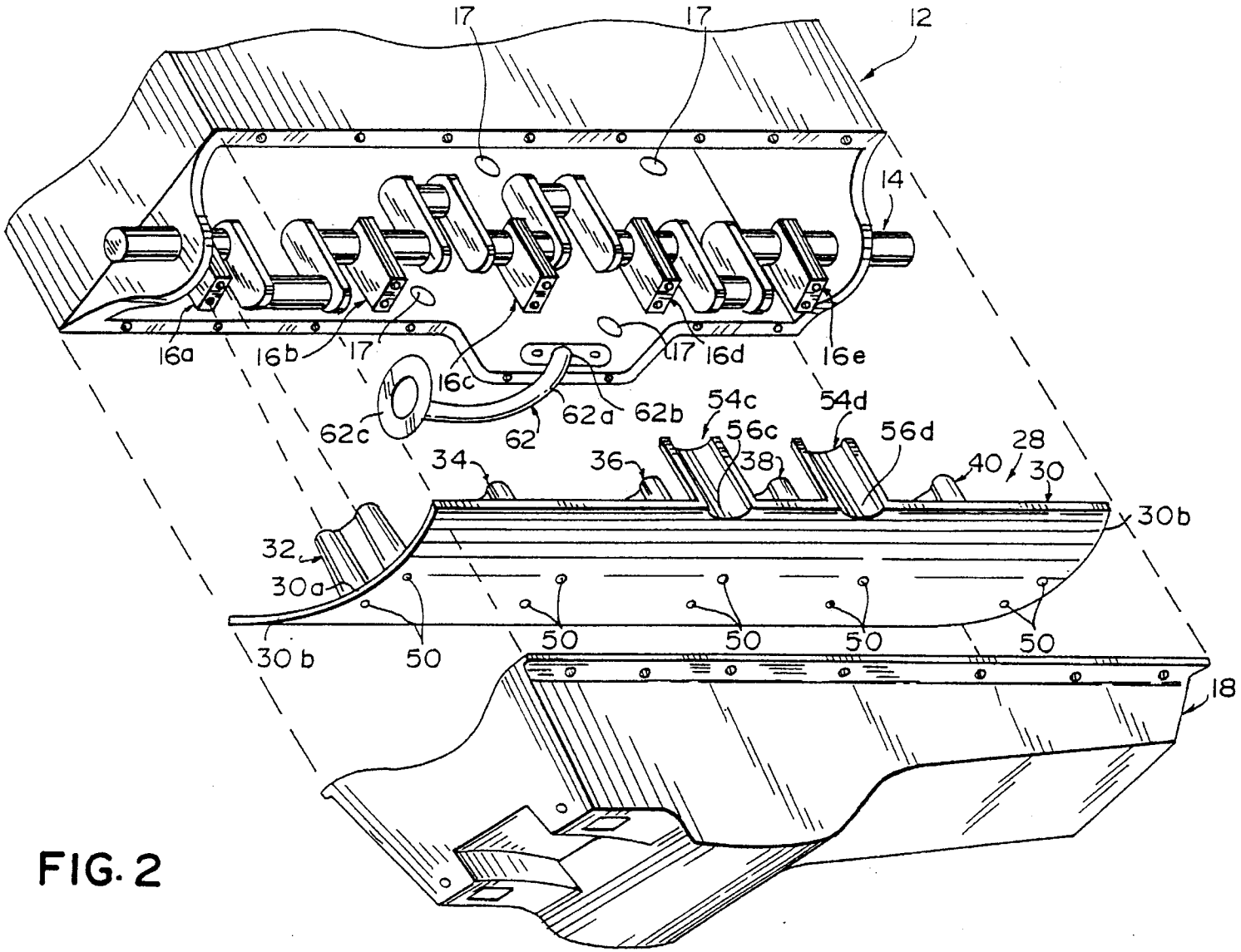
FIG. 2 is a partially exploded perspective view of an engine incorporating the structural baffle.

By way of disclosure, and not by way of limitation, an automobile engine 10 incorporating the present invention is shown in FIG. 1. The engine 10 includes an engine block 12, pistons 14*a–d*, connecting rods 15*a–d*, a crankshaft 14, bearing caps 16*a–e*, and oil pan 18. The pistons 14*a–d* are supported for reciprocating motion within cylinders 20*a–d* and are connected to the crankshaft 14 by the connecting rods 15*a–d*. The crankshaft 14 is in turn connected to the engine block 12 by bearing caps 16*a–e*. The oil pan 18 mounts to the lower surface of the engine block 12 to enclose the internal components of the engine 10 and provide an oil reservoir 19. While the present invention is described in connection with a conventional four-cylinder internal combustion engine, one of ordinary skill in the art will recognize the adaptations necessary to incorporate the structural baffle into a broad range of internal combustion engines.

The structural baffle 28 of the present invention is mounted to the lower side of the engine block 12. Referring now to FIGS. 3–6, the structural baffle 28 includes a baffle plate 42 having top 46 and bottom 48 surfaces, and a plurality of upright members 32, 34, 36, 38, and 40 extending from the top surface 46 of baffle plate 30 in a generally common direction. The upright members are spaced from and linearly aligned with one another. The baffle plate 30 is a generally rectangular plate having a ladder portion 30*a* extending longitudinally and a shallow arcuate skirt 30*b* extending laterally therefrom. The skirt includes two portion extending from opposite edges of the ladder.

While the precise dimensions of the baffle plate 30 will vary according to the design of the engine, the ladder 30*a* and skirt 30*b* preferably extend outward to and correspond with the dimensions of the oil pan 18. Likewise, the contour of the baffle plate 30 may vary from engine to engine. For example, the skirt 30*b* may be planar rather than arcuate.

Figure 3:
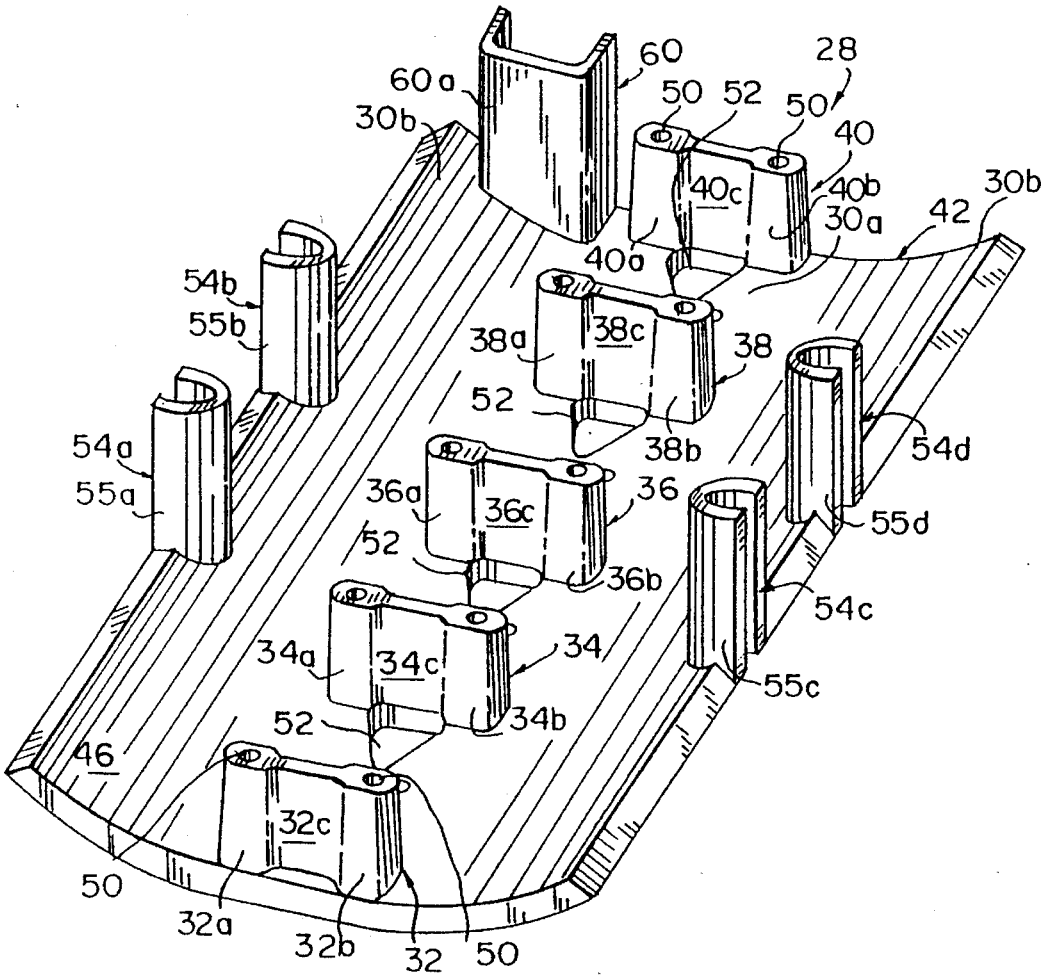
FIG. 3 is a perspective view of the present invention.
Figure 4:
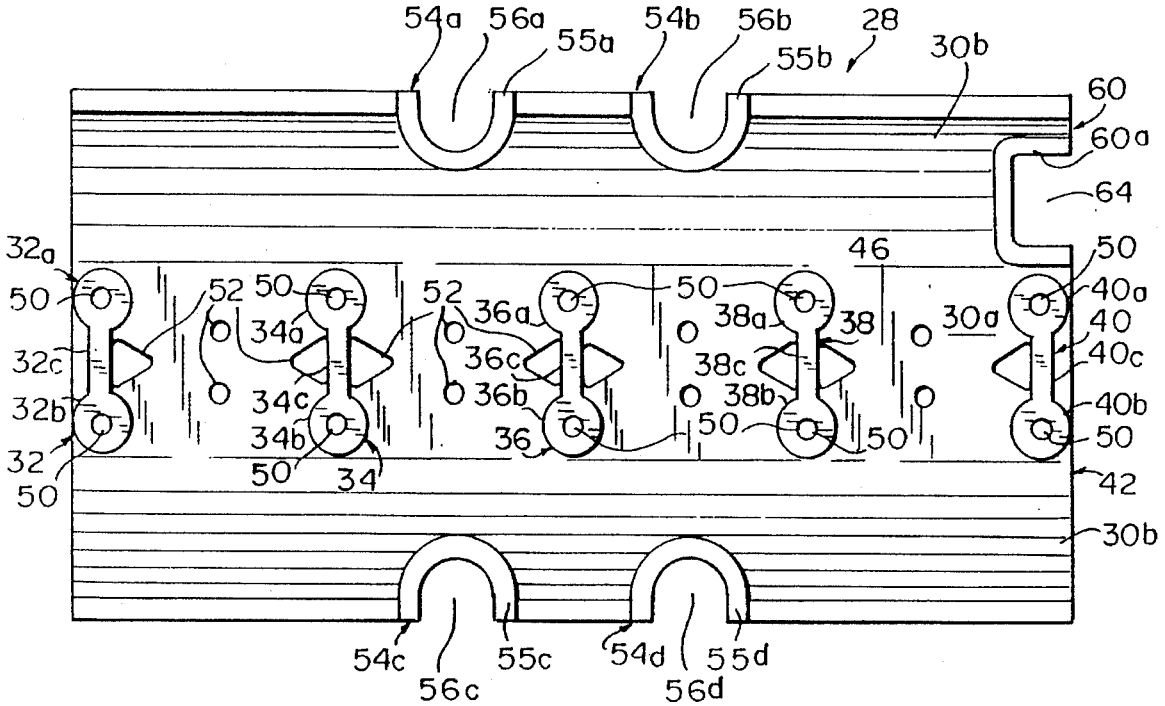
FIG. 4 is a top plan view of the present invention.
Figure 5:
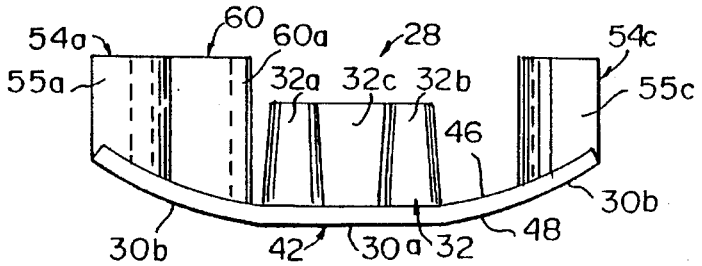
FIG. 5 is a front elevational view of the present invention.
Figure 6:
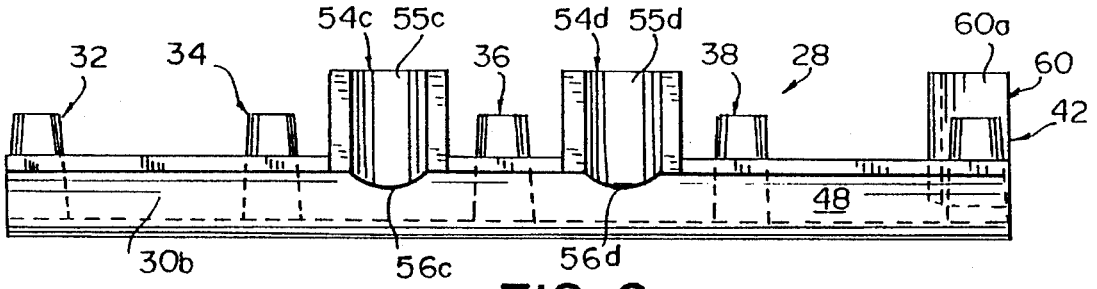
FIG. 6 is a side elevational view of the present invention.

As perhaps best illustrated in FIGS. 3 and 4, a plurality of openings 52 are formed through ladder 30*a* to allow oil flowing from the engine to return to the oil reservoir 19. In addition, a plurality of oil return towers 54*a–d* extend from the top surface 46 of the baffle plate 30 in generally the same direction as the upright members. The towers are in alignment with oil return ports 17 in the engine block 12. Each oil return tower 54 includes an arcuate wall 55*a–d* extending upward from a notch 56*a–d* formed through the baffle plate 30. The tower 54 forms an oil flow passage from the oil return ports 17 to the oil reservoir to channel the flow of oil therebetween.

Preferably, the baffle plate 30 includes a passage 60 for oil sump pickup assembly 62. The pickup assembly passage 60 is somewhat similar to oil return towers 54*a–d*, and includes an arcuate wall 60*a* extending upward from a notch 64 formed in the baffle plate 30. Notch 64 is of sufficient dimension to allow the sump pickup assembly hose 62*a* to pass therethrough. The size and location of the pickup assembly passage 60 may vary as necessary to match a given engine design.

As noted above, the disclosed embodiment of the present invention is designed for use in a conventional four-cylinder engine. Consequently, the structural baffle 28 includes five upright members extending upward from the top surface 46 of the baffle plate. The upright members 32, 34, 36, 38, and 40 are spaced apart such that each member aligns with a single bearing cap. The number and disposition of the upright members may vary as necessary to match a given engine design. Each of the upright members 32, 34, 36, 38, and 40 include a support wall 32*c*, 34*c*, 36*c*, and 38*c* extending between a pair of columns 32*a–b*, 34*a–b*, 36*a–b*, and 38*a–b*. A bore 50 extends longitudinally through each column to provide a means for securing the structural baffle 28 to engine block 12 by conventional bolts (not shown). The dimensions of the columns and support walls are selected to give the structural baffle 28 the desired strength and weight. However, the upright members 32, 34, 36, 38, and 40 must be of sufficient height to prevent the baffle plate 30 from extending through the throw of the crankshaft 14.

The structural baffle 28 is preferably fabricated of aluminum using conventional die casting methods and apparatus. However, other suitable materials and fabrication techniques may be used.

Assembly and Operation

The structural baffle 28 is bolted to bearing caps 16*a–e* by mounting bolts (not shown) that extend through bores 50. The structural baffle 28 bolsters the bearing caps 16*a–e* and reduces the amplitude of the torsional vibrations created during the sequential firing of the cylinders. The baffle plate 30 extends between the crankshaft 14 and the oil reservoir 19 to isolate the oil from the turbulence created by the spinning crankshaft 14. As noted above, openings 52 allow oil flowing from the engine to return to the oil reservoir 19. Further, the oil return towers 54*a–d* define an oil flow passages between the oil return ports 17 and the oil pan 18 to channel the oil and prevent the oil from entering the throw of the crankshaft 14.

As described above, the pickup assembly passage 60 preferably includes a notch 64 formed along the peripheral edge of the baffle plate 30. This allows the pickup assembly to be installed either before or after the structural baffle 28. In either case, the pickup assembly hose 62*a* is simply placed into notch 64 prior to installation of the oil pan 18. Alternatively, the pickup assembly passage 60 may be an opening defined through a central portion of the baffle plate 30. In such a case, the pickup assembly 62 may be installed after the structural baffle 28 by feeding the hose 62*a* upward from the oil pan reservoir through passage 60 and then mounting it to the pickup assembly port 62*b* located on the engine block 12. This method prevents the need for a pickup assembly passage 60 that is larger that the oil sump pickup 62*c*.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A structural baffle for an internal combustion engine having a crankshaft, said structural baffle comprising:

a baffle plate having top and bottom surfaces;

a plurality of spaced apart upright members extending in a generally common direction from said top surface of said baffle plate, said upright members being integral with said baffle plate so that said structural baffle comprises a single piece, said upright members being spaced apart from, and linearly aligned with, one another, each of said upright members including attachment means for facilitating attachment of said associated baffle member to the engine, whereby said structural baffle provides bolstering in the area of the engine crankshaft; and an oil return tower extending from said baffle plate in the common direction, said tower being integral with said baffle plate, said tower defining a passage for channeling oil flowing from the engine.

2. The structural baffle of claim 1 wherein said baffle plate defines an oil sump pickup assembly passage.

3. An internal combustion engine comprising: an engine block including an oil return port;

a crankshaft rotatably secured to said engine block by a plurality of bearing caps, said rotating crankshaft defining a throw;

an oil pan mounted to said engine block and defining an oil reservoir;

a one-piece structural baffle including a baffle plate dimensioned to overlie the majority of said oil pan, said structural baffle further including a plurality of uprights spaced from and linearly aligned with one another, said uprights extending from said baffle plate in a generally common direction and terminating in a free end, said free end of each of said uprights being secured to one of said bearing caps, each of said uprights having a height greater than the throw of said crankshaft, said structural baffle further including an oil return tower integral with and extending from said baffle plate in the common direction, said tower defining a channel aligned with said oil return port to channel oil flowing through said port to said oil reservoir.

4. An apparatus for reducing torsional vibration and oil aeration in an internal combustion engine comprising:

a baffle plate having integrally formed ladder and skirt portions, said ladder portion extending longitudinally and have opposite edges, one of said skirt portions extending from each of said opposite edges, said ladder portion and said skirt portions having upper and lower surfaces;

a plurality of upright members extending from said upper surface of said ladder portion at spaced apart locations, said upright members extending in a common direction, said upright members formed integrally with said baffle plate and adapted for mounting to the engine block; and at least one oil return tower integral with and extending from said upper surface of one of said skirt portions, said oil return tower defining a passage for channeling oil flowing from the engine.

* * * * *